United States Patent [19]

Lund et al.

[11] 4,241,663

[45] Dec. 30, 1980

[54] TIE PLATE HANDLING MEANS FOR RAIL CHANGING MACHINE

[75] Inventors: Raymond R. Lund, West Columbia; Hung C. Ho, Columbia, both of S.C.

[73] Assignee: Canron Corporation, West Columbia, S.C.

[21] Appl. No.: 951,130

[22] Filed: Oct. 13, 1978

[51] Int. Cl.[3] ..... E01B 29/24; B03C 1/12

[52] U.S. Cl. ..... 104/16; 209/215

[58] Field of Search ..... 104/7 R, 8, 16; 209/215

[56] References Cited

U.S. PATENT DOCUMENTS

| | | | |
|---|---|---|---|
| 3,423,858 | 1/1969 | Speno | 104/7 R |
| 3,435,779 | 4/1969 | Stewart | 104/7 R |
| 3,701,320 | 10/1972 | Fearon et al. | 104/16 |
| 3,943,858 | 3/1976 | Dieringer et al. | 104/16 |
| 4,178,236 | 12/1979 | Thevrer | 104/1 R |
| 4,178,237 | 12/1979 | Thevrer | 104/1R |

FOREIGN PATENT DOCUMENTS

| | | | |
|---|---|---|---|
| 2388086 | 11/1978 | France | 104/1 R |

*Primary Examiner*—Richard A. Bertsch

*Attorney, Agent, or Firm*—Wenderoth, Lind & Ponack

[57] ABSTRACT

In a rail changing machine which removes old rails, prepares the surfaces of the old ties and lays down new rail, a tie plate pick-up device is arranged to pick up the old tie plates and convey them selectively to a trailing car or to a tie plate positioning and dropping device where they are re-laid on the prepared ties. In the event that the old tie plates are not recycled new tie plates are conveyed to the tie plate dropping device. Permanent magnetic pick-up wheels are used and an electromagnetic tie plate holder is used at the dropping station. Problems of lateral alignment at both the pick-up and drop stations and tie plate orientation and longitudinal alignment with the ties at the drop station are overcome using novel mechanisms.

18 Claims, 10 Drawing Figures

TIE PLATE HANDLING MEANS FOR RAIL CHANGING MACHINE

BACKGROUND OF THE INVENTION

This invention relates to rail changing machines and, more particularly to such machines incorporating means for lifting tie plates and means for positioning tie plates after the ties have been prepared.

In rail changing techniques existing to date for lifting old rails from a track, after unspiking, preparing the old ties and laying new rails on the old ties various different operations with different machines have been necessary. One reason for this is that, before the old ties can be prepared it is necessary to remove the tie plates which may be recycled to a tie plate positioning means or it may even be necessary, in the case of laying larger rails, to replace the old tie plates with new tie plates. No satisfactory mechanism or device for handling adequately such tie plates from and including pick-up, conveying to dropping of the tie plates back on the prepared ties.

SUMMARY OF THE INVENTION

It is an object of the present invention to provide in a rail changing machine such tie plate handling means.

According to one aspect of the invention there is provided a rail changing machine having means for removing rails from a track, means for lifting the tie plates from the old ties, means for preparing the old ties, means for relaying tie plates on the prepared ties and means for laying new rails in the relaid tie plates, wherein the means for lifting the tie plates comprises at each rail location a first magnetic wheel rotatably mounted on a lateral axis and also mounted for generally vertical movement, means for moving the first magnetic wheel vertically downward for its engagement by its periphery with a tie plate on a tie and vertically upwards for raising the subsequently adhered tie plate off the tie, means for rotating stepwise the first magnetic wheel in the raised position to index a vacant space on the wheel periphery to a downward facing location of the wheel, means for removing from the top of the magnetic wheel tie plates adhered thereto, and means for conveying the removed tie plates to a desired location.

Preferably, the machine includes at each rail a second magnetic wheel aligned longitudinally with the first magnetic wheel and also rotatably mounted on a lateral axis, means for driving the second magnetic wheel at a predetermined speed in the opposite direction to rotation of the first wheel, a conveyor extending between the top of the first magnetic wheel and the bottom of the second magnetic wheel, means for driving the conveyor at a speed corresponding to the peripheral speed of the second wheel whereby tie plates removed from the first wheel upside down are conveyed to the second wheel to which they adhere, and means for removing tie plates from the top of the second wheel rightside up.

According to another aspect of the invention there is provided a rail changing machine having means for removing rails from a track, means for lifting the tie plates from the old ties, means for preparing the old ties, means for relaying tie plates on the prepared ties and means for laying new rails in the relaid tie plates, wherein the means for relaying tie plates on the prepared ties comprises an electromagnetic holder adapted to receive tie plates from a conveyor in the correct orientation, the electromagnetic holder being movable from a raised position for reception of a tie plate to a lowered position for dropping the tie plate on a tie.

BRIEF DESCRIPTION OF THE DRAWINGS

The invention will now be described in greater detail with reference to the accompanying drawings in which.

DESCRIPTION OF THE PREFERRED EMBODIMENT

Figure 1A:
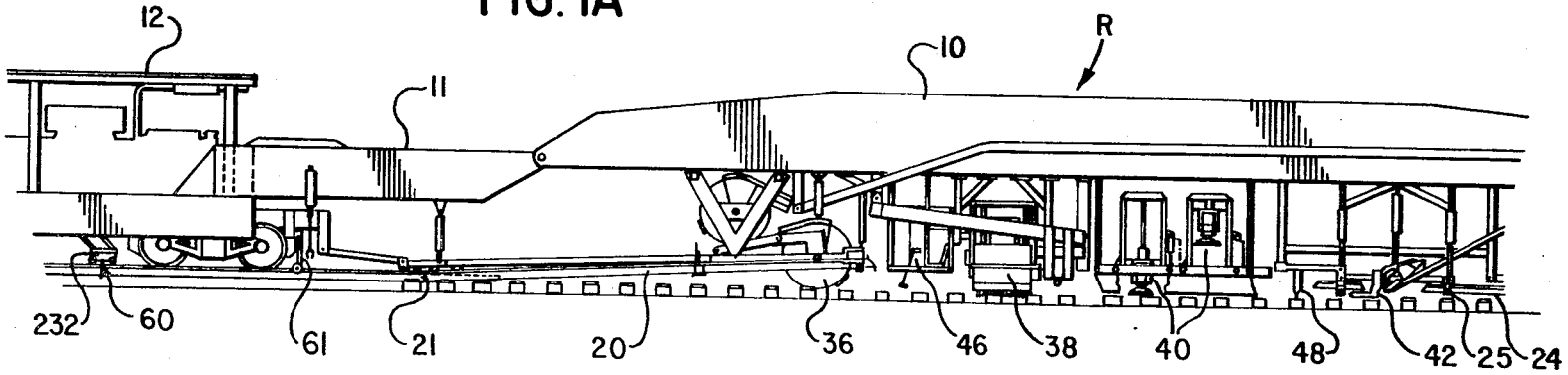
FIGS. 1A and 1B together constitute a schematic view of a rail changing machine incorporating novel tie plate pick up means, adzers and tie plate drop means.
Figure 1B:
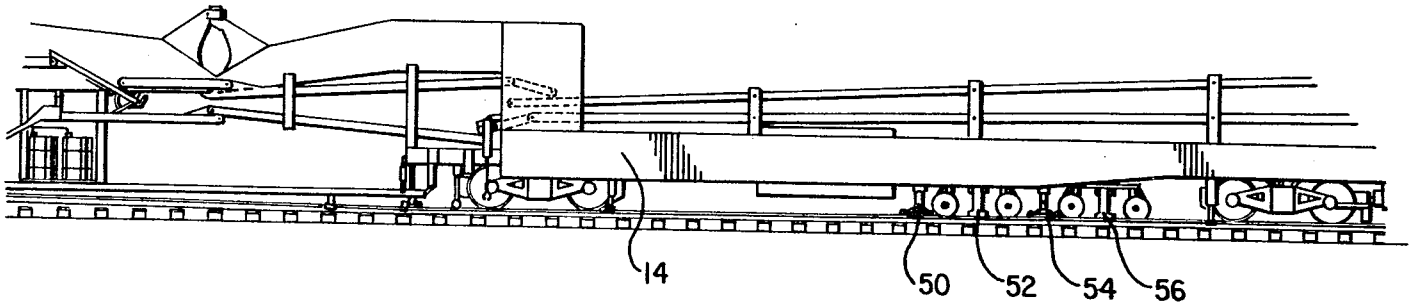

Referring to FIGS. 1A and 1B, the center beam or main frame 10 of a rail changing machine R is shown connected to the beam 11 of a leading powered car 12 and to the beam 13 of a trailing car 14. The old rails 20 of the old track are shown being picked up by rollers 21 of the old conventional rail removing means and these rails are then spread by spreaders (not shown) and deposited on the shoulders of the track in known manner. New rails 24 have previously been deposited on the shoulders of the track adjacent the existing rails 20 and new rail rollers 25 of a new rail laying means controlled by an operator pick up and lay the new rail, as is known.

Between the old rail moving means and the new rail moving means are positioned a series of track working instruments each mounted on a respective work frame. These instruments comprise, in turn, a magnetic pick-up means 36 for the tie plates left after lifting and spreading of the old rails, crib sweeping means 38 mounted in front of an adzer 40 and tie plate dropping means 42.

A hole plugging station 46 is provided between the tie plate pick-up 36 and the crib sweeper 38 and a creosoting station 48 is preferably provided after adzer.

A lining device 50, line spiker 52, gauger 54 and gauge spiker 56 complete the work stations.

In operation, the tie plate pick-up means 36 picks up the old tie plates left after lifting and spreading of the old rails, it being understood that the spikes securing the old rails to the ties would have been removed as a preliminary step, as is known. As the machine advances, a human operator in the hole plugging station injects a polyurethane foam into the old spike holes. The cribber 38 then sweeps a path in front of the adzer 40 to remove ballast and other debris from the line of the adzer which proceeds to adze the ties at the tie plate locations at each rail to provide flat beds of increased size in the upper surface of the tie which are capable of receiving new or recycled tie plates of increased size.

The creosoter 68 then supplies creosote to the adzed surfaces of the tie and the new or recycled tie plates are dropped onto the prepared ties by tie dropper 42 after which lining of the track, line spiking, gauging and gauge spiking are carried out.

Each of the various track working instruments does, of course, have means for operating simultaneously at the right and left rail locations. For example, the adzer comprises two adzer devices both mounted on a single frame and the crib sweeper comprises two spaced brushes mounted on the frame.

The pairs of devices at each work station are mounted on the respective frames at a distance apart corresponding to the track gauge and the frames are laterally movable conjointly in response to signals from a center line follower, which detects the track center line, so as to maintain the devices situated over the appropriate rail locations even on curved sections of track.

Figure 2:
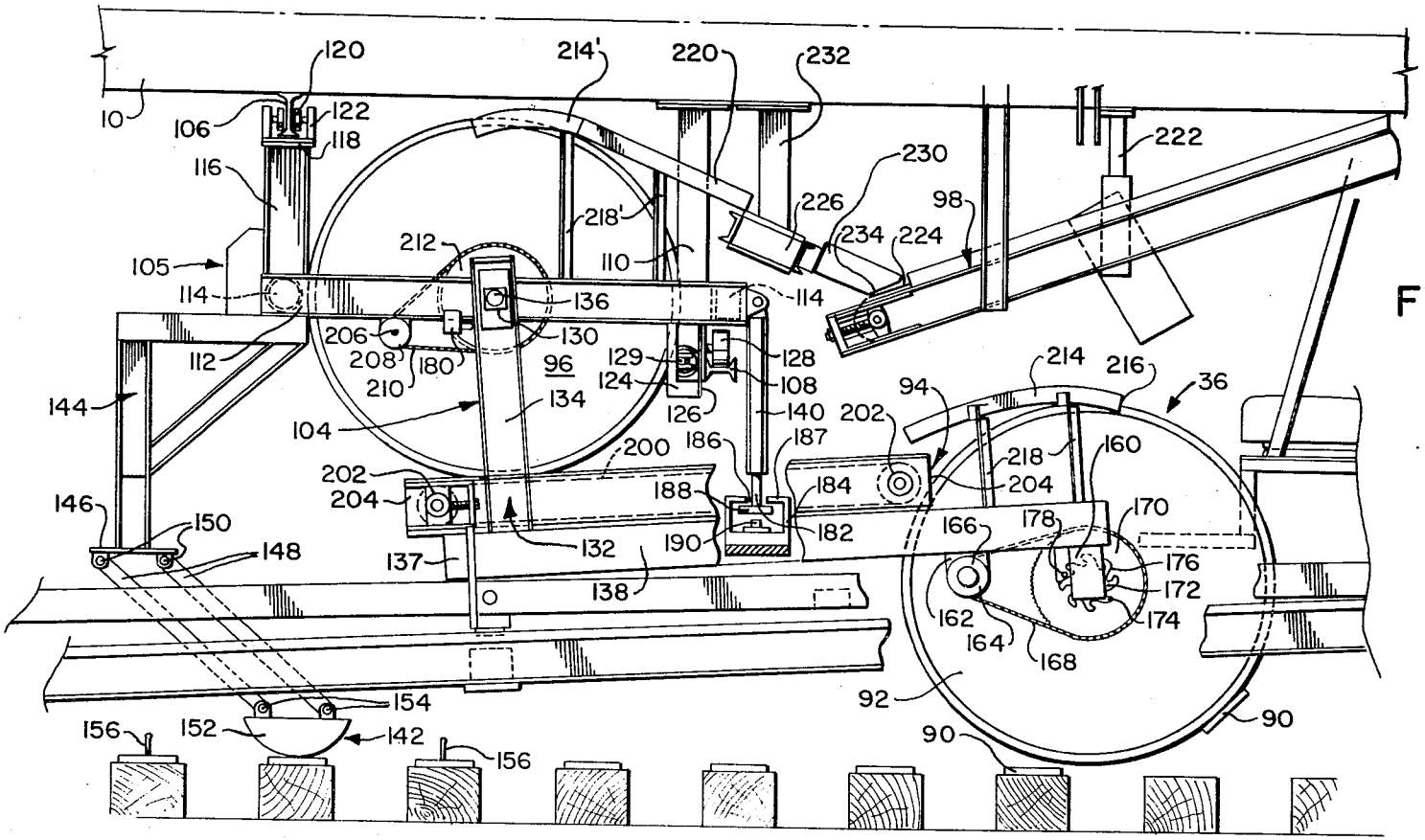
FIG. 2 is a side view of a tie plate lifting device incorporated in the machine of FIGS. 1A and 1B.

Referring now to FIG. 2, the device 36 for picking up old tie plates 90 from the ties comprises a first magnetic wheel 92 arranged to engage at its periphery the tie plates and rotate them counterclockwise on to a conveyor 94 along which they are conveyed to a second magnetic wheel 96 which transfers the tie plates clockwise to a conveyor 98 which conveys the tie plates ultimately to a trailing gondola car (not shown) or to a tie plate dropping mechanism which will be described below in detail. It should be understood that the above arrangement is duplicated for left and right rails so that there is a pair of such wheels aligned over each rail or, more accurately, each rail location as the old rails 20 have been lifted and moved off the tie plates at the position of the tie plate pick-up device.

Figure 2B:
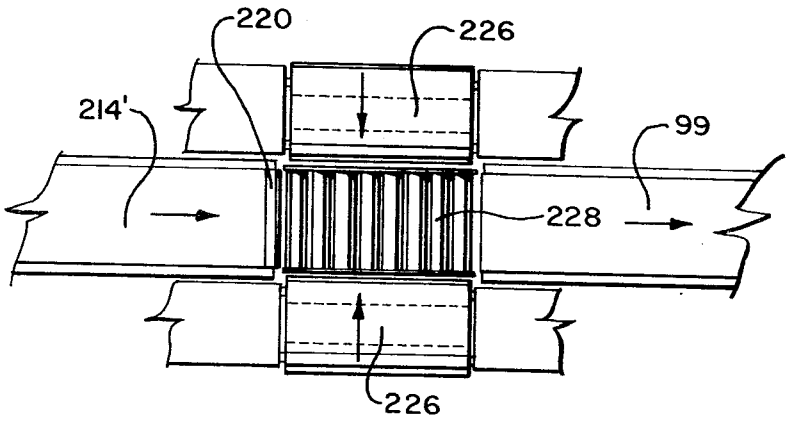
FIG. 2*b* is a plan view showing an arrangement for matching lateral movement of part of the lifting device with a conveyor which is fixed laterally.
Figure 2A:
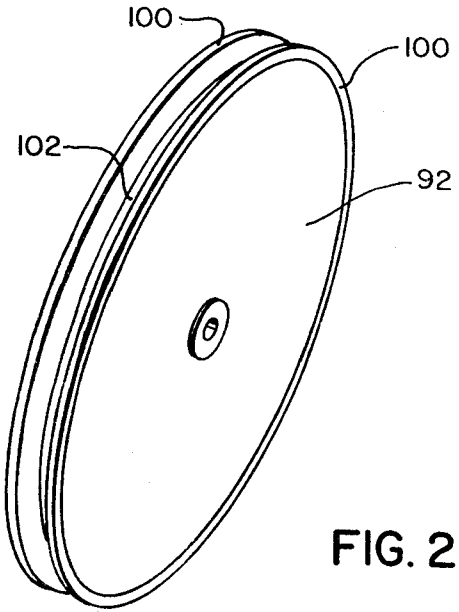
FIG. 2*a* is a fragmentary perspective view of the periphery of a magnetic wheel forming part of the tie plate lifting device.

Each wheel 92 or 96 is essentially non-magnetizable aluminum except for the periphery which is steel. As best seen in FIG. 2*a*, the periphery is formed with two equally radially extending continuous steel flanges 100 magnetically interconnected by a steel band 102 which extends around the entire periphery in the recess between the two flanges 100. Small permanent magnets (not shown) are mounted around the periphery of the wheel immediately under and magnetically engaged with the steel band 102.

Wheels 92 and 96 are rotatably mounted on transverse axes, wheel 92 being located behind, in the direction of travel of the rail changing machine, the other wheel and being disposed lower than wheel 96. A pair of such wheels is located, respectively, over each rail. Both pairs of wheels are carried on a frame 104 which is mounted for lateral movement on the main frame 10 of the rail changing machine. To this end, the main frame 10 carries an I-beam 106 welded to the underside of main frame 10 and extending transversely thereof, and main frame 10 carries another I-beam 108 welded to a support member 110, in turn welded to the underside of the main frame. I-beam 106 is disposed with its web vertical and I-beam 108 with its web horizontal.

Frame 104 includes two spaced longitudinally extending beams 112, one of which can be seen in the drawing, interconnected at their ends by transverse members 114 to form a rectangular subframe 105. Upstanding from the forward ends of beams 112 are vertical beams 116 the tops of which are interconnected by a flat transverse member 118. Two rows of rollers 120 are rotatably mounted in journal members 122 secured to the top of member 118 by bolts or other fastening means at both end portions of member 118. The rollers 120 are received on both sides of the web of I-beam 106 and run on flanges of the I-beam.

Near the trailing end of sub-frame 105 are two spaced depending members 124 interconnected by a transverse member 126 carrying along the trailing side thereof a row of rollers 128 which run along the upper surface of the web of I-beam 108. A hydraulic cylinder 129 connected, for example, between members 110 and 124 is operable to move frame 104 laterally, the two sets of rollers running along the respective I-beams.

The front wheel 96 of each pair is journalled between a respective one of the longitudinal beams 122 and a similar parallel beam (not shown) of the frame 104, the axes of rotation 130 being approximately mid-way along the beams 112.

Frame 104 incorporates also two separate L-shaped sub-frames 132, one at each rail location, which carry, respectively, the second wheels 92 of the two pairs. Each sub-frame 132 comprises two laterally spaced approximately vertical beams 134 each pivotably connected near its upper end to a respective one of longitudinal beams 112 by means of a pivot pin 136 protruding laterally outwardly from beam 112 at the rotation axis 130 of wheel 96. The two laterally spaced approximately horizontal members 138 form the other arm of the L-shaped sub-frame, members 138 being secured at their one end by welding to the generally vertical members 134. Horizontal members 138 are secured to each other at the forward end by a transverse beam 137. A pneumatic cylinder 140 is connected between each sub-frame 132 and the corresponding sub-frame 105 near the trailing end of the latter for raising and lowering sub-frame 132 by pivoting it about pin 136.

A centre-line follower 142 is supported intermediate the pair of wheels 92 and 96 on the right hand side of the machine and the pair on the left hand side by means of a sub-frame 144 which is mounted forward of wheels 96 to the forward transverse member 114 which joins longitudinal beams 112. Sub-frame 144 is equidistant from beams 112 and the centre-line follower 142 is pivotally connected to the bottom portion 146 of sub-frame 144. Specifically, two links 148 of the centre line follower are mounted at their upper ends to pivot pins 150, the lower ends of links 148 being pivotally mounted to the body 152 of centre-line follower 142 by means of pivot pins 154.

The body 152 of the centre line follower is adapted to run along the track in engagement with the upper surfaces of the ties as shown and move to right or left as it engages a line of nails 156 which have previously been driven into the ties to mark the centre line of the track. For a more detailed description of the construction of the centre-line follower reference may be made to copending application Ser. No. 951,131 of Raymond Ralph Lund filed on even date and entitled Center Line Follower. The centre-line follower is so constructed to derive a signal to control the cylinder 129 via a solenoid valve (not shown) so that the frame 104 is moved to the right or left to follow the centre line of the track thus to accommodate curves on the track. By this means tie plate pick-up wheel 92 may be kept essentially at a constant distance from the track centre line. The reason that this is so important is that the wheel is designed to engage the central flat portion of the upper surface of the tie plates and if the wheel is greatly off the tie plate centre line it will not make good contact with the tie plates which may not adhere to the wheel.

The lower wheel 92 is mounted between the trailing end portions of the laterally spaced approximately horizontal members 138. Specifically, the wheel 92 is journalled between two brackets 160 mounted, respectively, to the trailing end portions of members 138. A bracket 162 mounted on one of horizontal members 138 supports a constant torque hydraulic motor 164 driving a sprocket 166. A chain 168 drivingly connects sprocket 166 to a sprocket 170 which is rigidly connected to wheel 92. Sprocket 170 carries a centrally mounted dog plate 172 which is formed with a plurality of dogs 174 defined by peripheral recesses 176. A hydraulic cylinder 178 is also mounted on outer bracket 160 and this is arranged so that the piston (not shown) thereof extends through a hole (not shown) in bracket 160 and into registry with the recesses and pawls of plate 172. Engagement of a dog 174 with the piston prevents rotation of the wheel 92 but when the cylinder 178 is powered momentarily, the piston retracts permitting rotation of wheel 92 counter-clockwise, as seen in the drawings, under the driving action of the hydraulic motor 164.

As energization of the cylinder 178 is only momentary, the piston is immediately received in the succeeding recess and engages the succeeding dog to stall motor 164 until the cylinder 178 is energized again. Thus, the wheel can be rotated in step-wise fashion, i.e. indexed, by energizing the cylinder. Energization of cylinder 178 is controlled by a limit switch 180 mounted on one of the longitudinal beams 112 of sub-frame 105 near the pivot 130 for actuation by the adjacent approximately vertical member 134 when member 134 has pivoted away from switch 180 by a predetermined distance. This distance corresponds to a predetermined height, e.g. 3 inches, by which the wheel 92 has been raised off the tie surface.

Pneumatic cylinder 140 which, as briefly described above, is connected between each sub-frame 132 and corresponding sub-frame 105, will now be described in more detail. The interconnections between, the piston rod 182 and sub-frame 132 is made via a housing 184 rigidly secured to sub-frame 105 and having a hole 186 in its top wall 187 through which hole the piston rod free end portion is slidably received. The free end 188 of piston rod 182 is formed with an increased diameter which, because it is wider than hole 186, is prevented from rising clear of the housing 184. A limit switch 190 is secured inside housing 184 such that when piston end 188 is in abutment with top 187, piston end 188 is clear of switch 190 and when piston end 188 moves downwardly relative to top 187, piston end 188 actuates the limit switch 190. The cylinder 140 is normally in the retracted position but piston rod 182 may be extended under command from a manually operable "start" button and solenoid valve (not shown). Limit switch 190 controls via the solenoid valve retraction of piston rod 182 when the limit switch is activated. The design of the interconnection described above is such that when piston rod 182 is extended when desired by the operator, the weight of the sub-frame 132, wheel 92 and other components mounted on sub-frame 132 is sufficient to tend to permit housing 184 to drop faster than piston 182 is extending, thus keeping piston end 188 in abutment with housing top 187, i.e. clear of switch 190. The sub-frame 132 does, of course, pivot about axis 130 at a speed determined by the rate of extension of piston rod 182.

When wheel 92 abuts against a tie plate 90 on one of the ties, further downward movement of housing 184 is prevented and piston rod 182 continues to extend until piston end 188 engages and actuates limit switch 190 causing retraction of piston rod 182 to pivot sub-frame 132 and wheel 92 upwardly. As indicated above, after a predetermined upward travel, say 3 inches, the limit switch 180 is actuated. This cuts off further fluid to the cylinder 140 to retain it in the up position.

Limit switch 180 also controls through a solenoid valve (not shown) the operation of hydraulic cylinder 178 such that, when switch 180 is actuated after the 3 inch upward movement of wheel 10, the piston thereof is retracted momentarily allowing the wheel 92 to be indexed the angular distance between two consecutive dogs 174 under the action of hydraulic motor 164. The reason for raising wheel 92 is to permit the tie plate 90 which had become adhered to the periphery of wheel 92 to be rotated on wheel 92 without interference between the tie plate and the tie on which it was lying. The angular distance indexed is sufficiently great to ensure that each adhered tie plate is rotated away from the bottom position so that the successive tie plate may be adhered to the wheel 92 as the machine advances to the next tie plate.

Conveyor 94 is supported on the sub-frame 132 and is simply an endless belt 200 mounted on sprockets 202 rotatably mounted between vertical side plates 204. A motor (not shown) also housed between plates 204 drives the belt through one of the sprockets 202 at a constant speed which is matched to the rotational speed of the wheel 96 so that there is essentially zero relative motion between the magnetized periphery of wheel 96 and belt 200 which assists in ensuring good transfer from belt 200 of the tie plates. The drive means for wheel 96 is similar to that for wheel 92 except that there is no indexing mechanism. Thus, motor 206 mounted on a longitudinal beam 112 drives continuously sprocket 208, chain 210 and sprocket 212 mounted on wheel 96.

The means for removing the tie plates adhered to wheels 92 and 96 is essentially the same for both wheels and comprises, in the case of wheel 92, a sloping chute 214 recessed at its trailing edge 216 which is positioned at the top centre position of the wheel by means of support legs 218 mounted on beams 138 such that the magnetized wheel periphery passes through the recess as the wheel rotates. The slope and curvature of the chute is arranged such that when a tie plate adhered to the wheel passes just beyond top centre it is engaged by the chute which scrapes off the tie plate which then falls under gravity on to the corresponding conveyor. Chute 214' for wheel 96 is similarly arranged on support legs 218' mounted on beams 112.

Because wheels 92 and 96 are movable with frame 105 laterally inwardly and outwardly in response to the action of the centre-line follower 142 as described above it should be apparent that the delivery end 220 of chute 214' will also move inwardly or outwardly by an amount dependent on the degree of curvature of the track. However, the conveyor 98 which conveys the tie plates back to the gondola car or to the tie plate dropping means is mounted to the main frame 10 of the machine by means of rigid connecting members, such as member 222 and this conveyor cannot be moved laterally. Accordingly, it is necessary to provide between delivery end 220 of chute 214' and the input end 224 of conveyor 98 (which is conveniently an endless belt or series of endless belts mounted and driven in a manner similar to that of conveyor 94 described above) means for matching laterally movable end 220 to fixed end 224. This matching means comprises two small conveyors 226 (See particularly FIG. 2*b*) disposed one on each side of a central conveyor 228, the upper surfaces of these conveyors being coplanar with that of lower portion of chute 214'.

Central conveyor 228 is a low-friction non-driven roller conveyor, the rotational axes of the rollers being perpendicular to the slope direction of the chute 214'. Conveyors 226 are continuous belt conveyors, the belts of which are driven with their upper stretches moving towards conveyor 228 as indicated by the arrows in FIG. 2*b*. Completing the matching means is a short chute 230 disposed at the lower, i.e. output side of conveyor 228. The whole arrangement of conveyors 226 and 228 and chute 230 may be connected together as one assembly and mounted to the main frame 10 by means of a rigid member such as vertical beam 232 such that the output end 234 of chute 230 is aligned laterally with conveyor 98.

It should be readily appreciated that as delivery end 220 of chute 214' moves laterally tie plates will be delivered to one side or other of roller conveyor 228 either completely or partly overlying one or other of conveyors 226. The action of conveyors 226 is to return off centre tie plates to the roller conveyor 228 where they will roll under gravity onto fixed chute 230 and subsequently onto fixed conveyor 98.

The complete operating sequence of the tie-plate lifting device described above is summarized as follows:

1. The operator, who would normally be seated at a location just behind the tie-plate lifting device operates the "start" button when the wheel 92 is over a tie-plate 90.

2. This causes wheel 92 to drop into engagement with the upper surface of the tie-plate which becomes adhered to the wheel.

3. Actuation of limit switch 190 causes raising of wheel 92 to a position at which limit switch 180 is activated.

4. Activation of limit switch 180 stops upward travel of wheel 92 and indexing of wheel 92 to rotate the adhered tie plate out of the bottom centre position.

5. The wheel is retained in that position until the wheel is positioned over the next tie and tie plate at which the operator pushes the "start" button to repeat the cycle.

Every time wheel 92 is indexed the leading tie plate on that wheel is scraped off by chute 214 and delivered upside down on to conveyor 94.

The plates on conveyor 94 are consecutively engaged on their undersides by wheel 96 from which they are scraped off by chute 214 as they reach the top position. The plates then slide down chute 214' right side up and on to conveyor 98 via the conveyor matching means.

While the above operations are taking place frame 105 is continuously tracking to right and left as necessary to follow the centre line to position wheel 92 at the correct location.

Old tie plates picked up by the pick-up device described above are fed by conveyor 98 back along the rail changing machine as best seen in FIG. 1. The conveyor 98 continues all the way back to the gondola car where they may be stored or dumped off at the side of the track. However, the old tie plates can be recycled by means of a gate 240 which selectively connects conveyor 98 with a forwardly running conveyor 242 which feeds the tie plates down a chute 248 to the tie plate drop device 42. The conveyor 242 extends all the way back also to the gondola car where new tie plates, for example larger tie plates if larger rail is being laid, can be loaded on instead of recycling the old tie plates. For that case, gate 240 would be pivoted to the up position.

This is a device for receiving tie-plates, either new or recycled from conveyor 242' and automatically positioning and guiding these tie plates so that each tie plate drops at the correct location on the newly adzed portion of the respective tie.

There are three main aspects of positioning which are important. The first is that the tie plates must be correctly spaced laterally with respect to the track centre line and the second is that the tie plates must be dropped at the correct longitudinal location to ensure that the tie plates are placed centrally with respect to the tie width, i.e. so that tie plates do not overhand or miss altogether the ties. The third aspect of positioning is that the tie plates should not be skewed relative to the rail axis so that the rails will fit into the tie plates.

Figure 3:
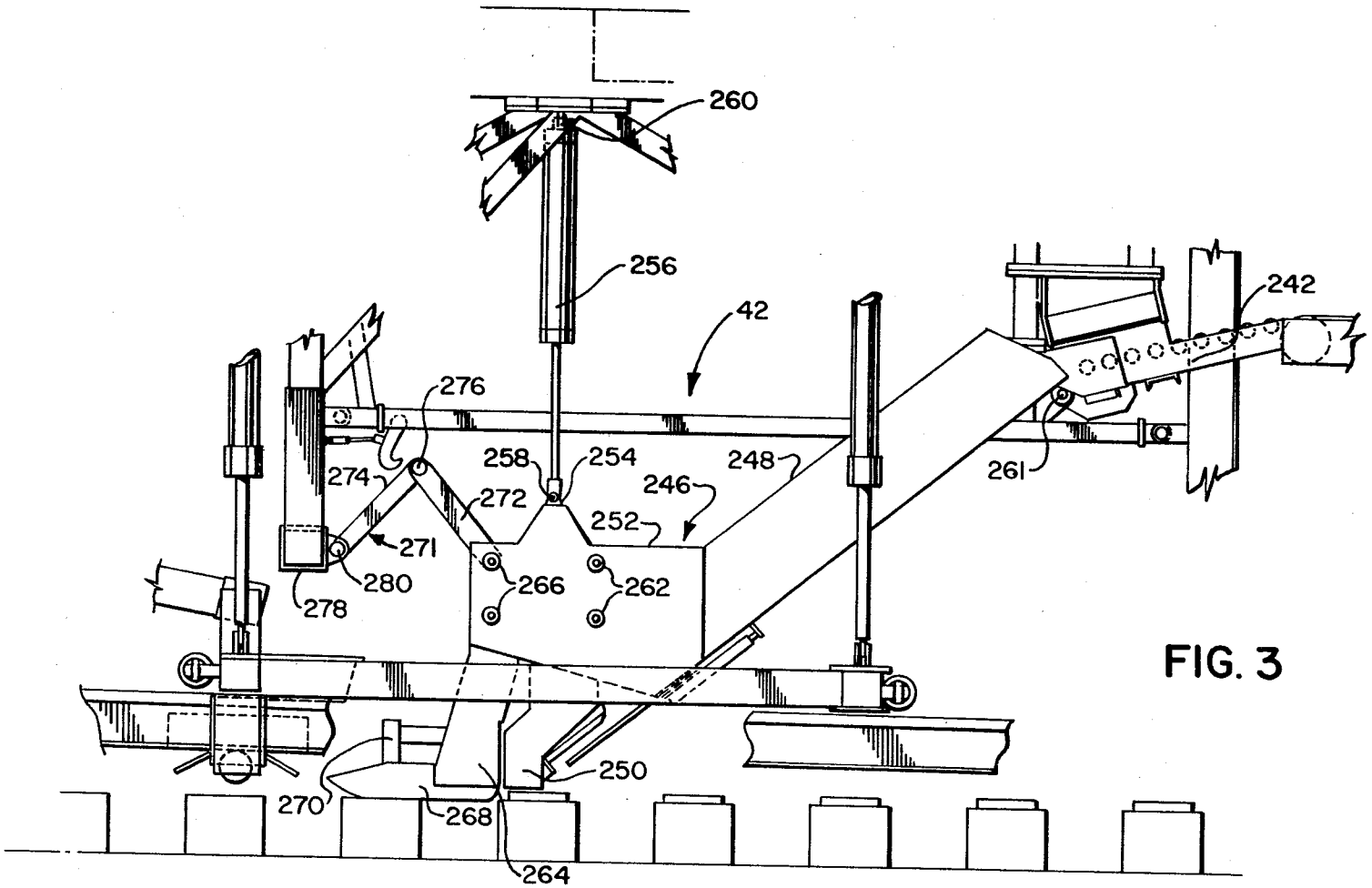
FIG. 3 is a side view of a tie plate dropping device incorporated in the machine of FIGS. 1A and 1B.

Referring to FIG. 3, the tie plate drop device 42 comprises a chute 248 extending from the delivery end of conveyor 242 down into a tie plate holding device 250 which protrudes through the open bottom of housing or frame 252 which is integral with chute 248. Extending across the top of frame 252 is a beam 254 (see FIG. 4) which is connected to the main frame 10 of the rail changing machine by means of a pneumatic cylinder 256 mounted on pivot pins 258 and 260. The combined chute 248 and frame 252 assembly 246 is pivotally mounted to main frame 10 at the trailing end of chute 248 by means of a pivot pin 261. Thus, extension or retraction of cylinder 256 causes pivoting of frame 252 about pin 261.

Associated with the tie plate holding device 250 is a referencing device 264 which is also mounted on frame 252 for lateral movement on rods 266 and also protrudes below the frame 252. Referencing device 264 ends on a skid 268 which runs on the adzed ties and is sufficiently long to bridge two consecutive ties. Extending inwardly of skid 268 is a rigid member 270 which carries a centre line follower (not shown) which is identical to the centre line follower 142 of the plate pick-up device.

Referencing device 264 is movable laterally along its guide rods 266 by means of two parallel spaced double linkages 271 each comprising a first member 272 having, a through hole at its lower end which hole pivotally and slidably receives the upper guide rod 266 and a second member 274 pivotally joined to the first member at the upper end of the first member by means of a pivot pin 276. The lower end of member 274 is pivotally joined to a transverse slide member 278 by means of a pivot pin 280. Because of the parallel arrangement of the double linkages, the one pivot pin 276 is used for both linkages as is pivot pin 280. A strengthening sleeve 282 extends laterally and around pivot pin 276 between the two linkages and a similar sleeve 284 receiving pivot pin 280 extends between the two linkages.

Slide member 278 is rectangular and is received slidably on a rectangular cross beam 286 which is supported on a vertical beam 288 welded to the main frame 10 of the rail changing machine. A pneumatic cylinder 290 is connected between vertical beam 288 and slide member 278 for moving slide member 278 and the double linkage laterally inwardly and outwardly. The centre line follower is arranged to control operation of cylinder 290 in the same way that the centre line follower 142 of the tie plate pick-up device controls operation of cylinder 129.

The plate drop device will now be described in greater detail with reference to FIG. 4 and FIG. 5. Chute 248 has two side walls 292 and a slide surface 294. Extending parallel with the side walls 292 are two spaced guide members 296 which are supported above slide surface 294 by rods 298 extending between guide members 296. Any suitable fastening means may be used to fasten guide members 296 at any selected lateral position and spacing. For example nuts 300 with threaded portions on the rods 298 may be used. Also, rods 298 may be arranged in slots in side walls 292 to permit the spacing of guide members 296 with respect to the slide surface 294 to be varied. Guide members are bent towards each other at top and bottom portions 302 and 304.

The purpose of chute 248 is to convey in approximately the correct orientation and lateral positioning tie plates 90 from conveyor 242 to tie plate holding device 250. As a tie plate slides from conveyor 242 right side up onto chute 248, the guide members 296 are received in the central recess 306 of the tie plate, portions 302 at the top of the guide members serving to guide the tie plate onto the guide members. It will be appreciated that the height and spacing of guide members 296 is previously chosen to match the type of tie plate.

Figure 4:
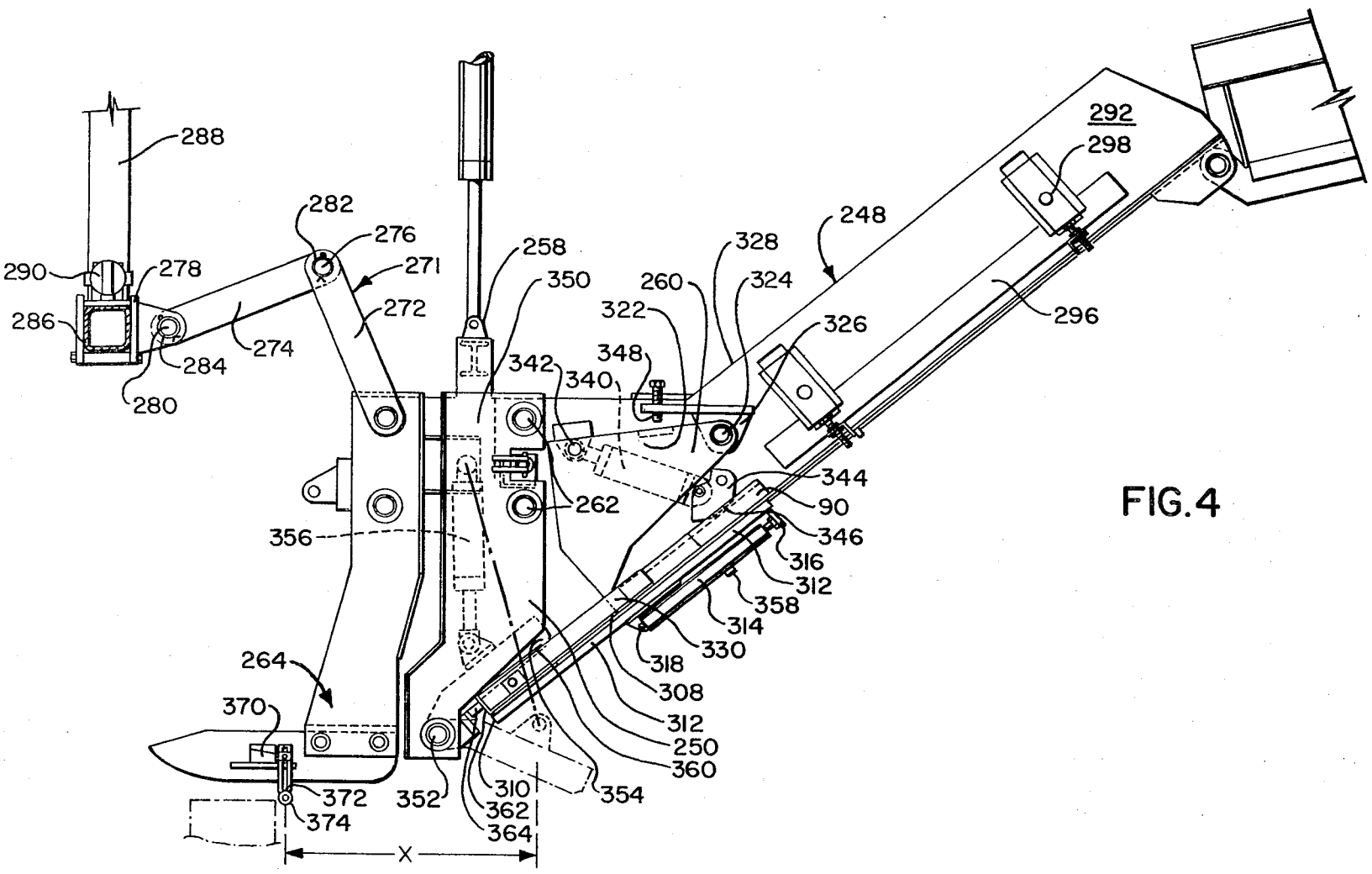
FIG. 4 is a view similar to FIG. 3 but showing more detail of the tie plate dropping device.
Figure 5:
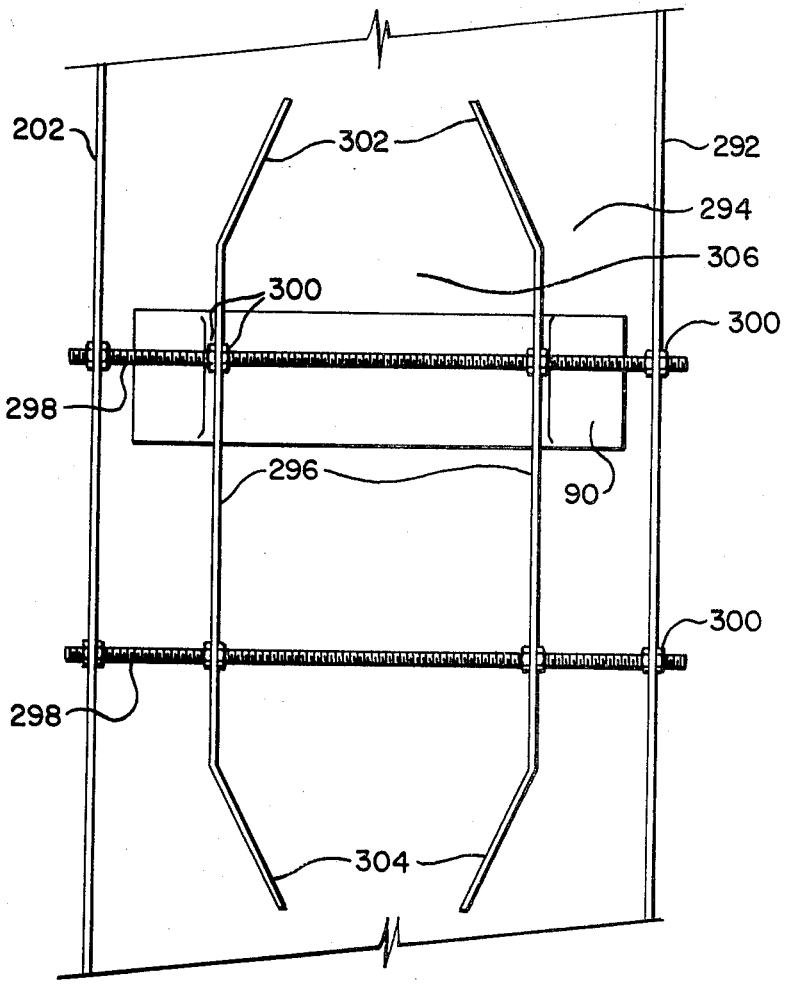
FIG. 5 is a plan view of a guide arrangement for orienting the tie plates properly for reception in the tie plate holder.

Referring now to FIG. 4, it can be seen that the slide surface 294 extends downwardly beyond the side walls 292 and guide members 296, the end of slide surface 294 being referenced 308. However, this slide surface is effectively extended to point 310 by means of a plate 312 slidably supported under the lower end of chute 248 and movable parallel to slide surface 294 by means of a pneumatic cylinder 314 connected between bracket 316 of plate 312 and bracket 318 connected under chute 248.

Located between the lower ends of guide members 296 and tie plate holder 250 is a device 260 for indexing the tie plates to the holder 250. This device comprises a gate 322 pivotally mounted at its upper end by means of a pin 324 to brackets 326 mounted to a plate 328 extending across chute 248. At an end remote from pivot pin 324, gate 322 is formed with a finger 330 engageable with the slide surface 294 adjacent end 308.

Gate 322 is formed of two identical spaced plates between which is disposed a pneumatic cylinder 340. Cylinder 340 is pivotally mounted at its one end at a pivot pin 342 extending between the spaced plates and is pivotally mounted at its other end to a foot member 344 having a surface 346 which is gently curved and positioned to engage tie plates 90 disposed on slide surface 294.

Extension of cylinder 340 causes foot 344 to be urged hard against the tie plate 90 immediately following that retained by finger 330, and to pivot gate 322 clockwise (as seen in FIG. 4) about pivot pin 324, upward rotation being limited by abutment of gate 322 against a stop 348. Such pivoting frees finger 330 from the leading tie plate thus permitting the leading tie plate to slide further down surface 294 and plate 312 into the plate holder 250. Because of the force exerted by foot 344, the next tie plate is prevented from sliding. When cylinder 340 is retracted subsequently, finger 330 is rotated to assume its original position and, because the force exerted by foot 344 has now been removed, the next tie plate is free to slide down to be retained by finger 330 and another tie plate takes its place under foot 344. Extension and retraction of cylinder 340 are brought about by means of a manually operable "start" button (not shown).

The plate holder 250 comprises a housing 350 supported for sliding movement on rods 262. Housing 350 has two spaced side walls between which is mounted a pivot pin 352 located at the bottom of housing 350 and pivotally supporting a lower end of an electromagnet 354. The electromagnet 354 is retained upwardly inclined at an approximately 45° angle with respect to the horizontal by means of a pneumatic cylinder 356 which is disposed generally vertically in housing 350. Cylinder 356 is pivotally mounted at its upper end to housing 350 and at its lower end to electromagnet 354. Thus, extension of cylinder 356 rotates electromagnet clockwise to a downwardly inclined position. Operation of cylinder 356 is under control of a proximity switch 358 on slide retraction cylinder 314 so that pivoting of electromagnet 354 to its down position can only occur after retraction of slide 312.

Electromagnet 354 has an elongate recess 360 which extends from the upper end thereof and defines a space into which the leading tie plate will slide when released by gate 322. The lower end of the recess is formed as a stop surface 362. A limit switch 364 is mounted in stop surface 362 and this is operable to extend a gauge cylinder (not shown) which is mounted in recess 360 and extends laterally thereof. When the gauge cylinder is extended it engages the side of a tie plate in recess 360 and urges it laterally against a stop (not shown) which stop is accurately referenced to the means described below for moving electromagnet 354 laterally to the position at which the tie plate has to be dropped.

Figure 6:
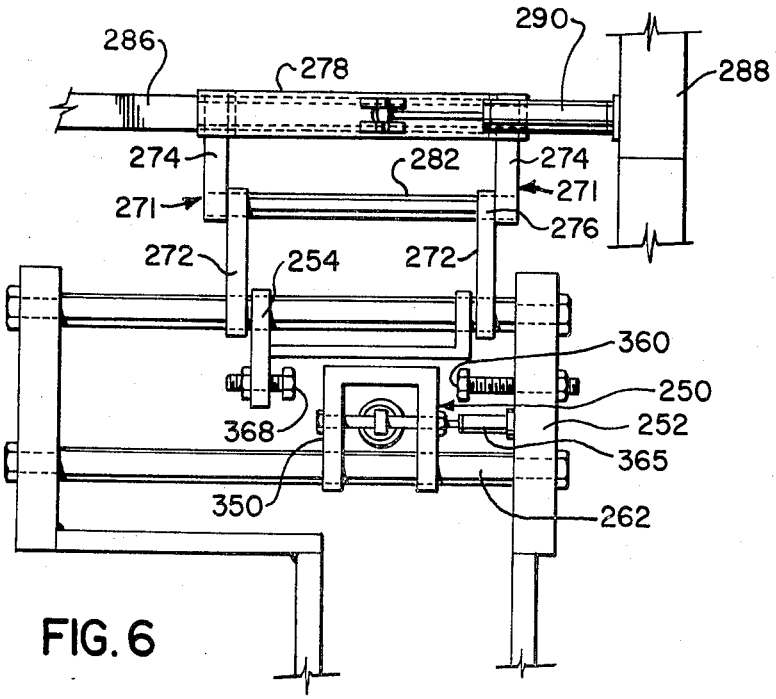
FIG. 6 is a plan view of the tie plate dropping device of FIG. 3, portions being omitted for clarity.

Referring now to FIG. 6, tie plate holder 250 is shown supported on rods 262 for sliding movement relative to frame 252. A pneumatic cylinder 365 is connected between one vertical wall of frame 252 and housing 350 of plate holder 250 for moving tie plate holder 250 laterally outwardly. A stop 366 adjustably mounted on the inner wall of frame 252 determines the inner limit of travel of the plate holder 250.

Referencing device 264 is also shown in FIG. 6. This can be seen to be sandwiched between the double linkages 271 which as indicated previously are laterally movable by cylinder 290 under control of a centre line follower. A stop 368 is adjustably mounted at a laterally outer location of referencing device 254, the stop 368 being disposed in the line of travel of the plate holder 250 and, accordingly, defining the lateral outward limit of travel of tie plate holder 250. Both stops 366 and 368 may conventionally be threaded members which can be adjusted in lateral position simply by turning.

It should be understood that referencing device 264 is moved laterally as the centre line follower tracks laterally and that the stop 366 is used as the varying reference for determining the required lateral position of a tie plate. The magnetic tie-plate holder 250 is pushed laterally outwards by its cylinder 365 until it abuts stop 366 at which point the tie plate holder 250 will be at the correct lateral position. The complete operating sequence of the tie plate dropping device described thus far will now be summarized, it being understood that cylinder 256 has been extended so that skid 268 is in engagement with the ties of the track.

1. On operation by an operator of the "start" button, gate 322 is released and the leading tie plate is indexed into the electromagnet recess.

2. The tie plate actuates the limit switch 364 in the recess which causes extension of the gauge cylinder to push the tie plate laterally hard up against the reference stop in the recess. Activation of this limit switch also starts an electronic timer.

3. After timing out of the timer the electromagnet 354 is energized and the slide 312 is simultaneously withdrawn leaving the tie plate adhered to the electromagnet.

4. When slide 312 has been fully withdrawn, proximity switch 358 is activated and this causes extension of cylinder 356 and pivoting of electromagnet and tie plate down into engagement with the tie.

5. At the same time as electromagnet 354 is energized, cylinder 365 (FIG. 6) is extended due to timing out of the timer and this causes electromagnet 354 and the adhered tie plate to move laterally away from the chute 248 until housing 350 engages stop 368 of referencing device 254.

6. Referencing device has, independently of the above operations, been tracking right or left in response to the centre line follower.

The tie plate is now in the correct orientation and correct lateral distance to be dropped onto the prepared tie. However, it still remains to ensure that the tie plate is dropped in the correct longitudinal location so that the tie plate does not miss or overhang the tie and the following description relates to means for ensuring just that.

With reference again to FIG. 4, the skid 268 incorporates a limit switch 370 actuable by an arm 372 extending below the skid 268 and carrying at its lower end a wheel 374. Limit switch 370 is tripped or actuated by wheel 374 engaging the trailing edge of a tie and it is opened by wheel 374 leaving the forward edge of the tie. A distance encoder 376 is driven by a track engaging wheel 61 located near a front boggie of the rail changing machine R (see FIG. 1).

Figure 7:
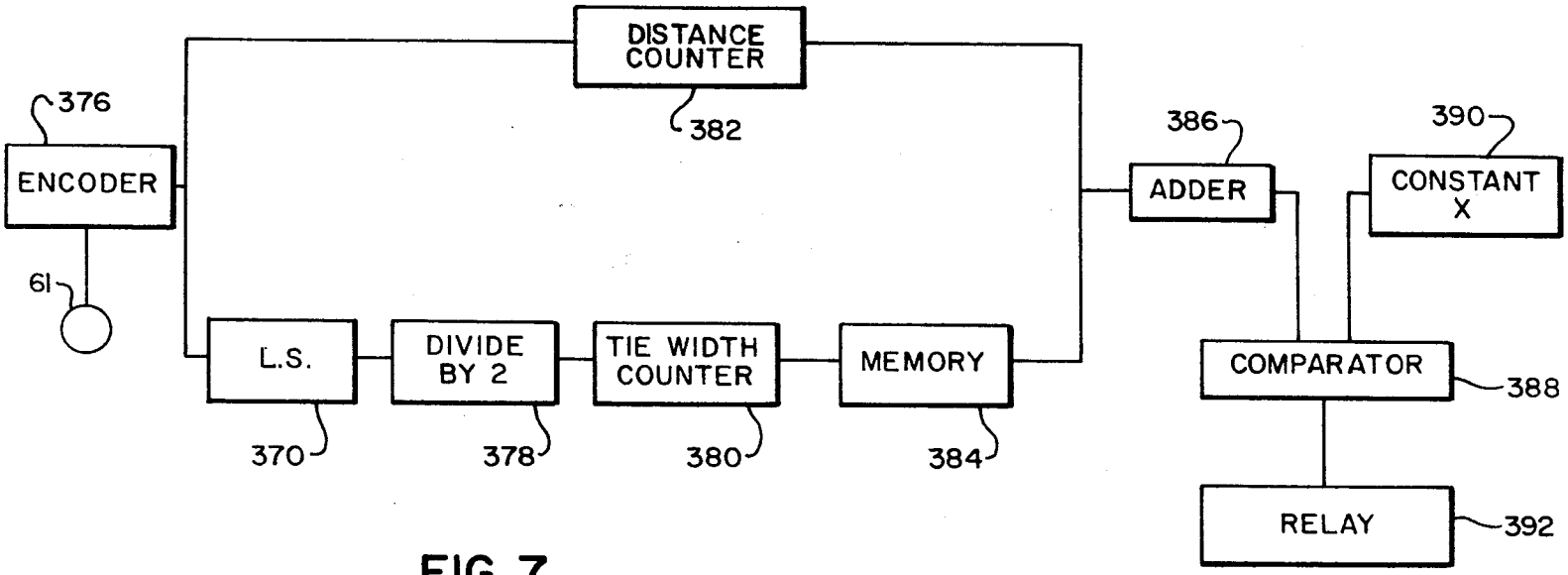
FIG. 7 is a block diagram of a digital distance measuring device for dropping the tie plates at the proper location on the ties.

Referring to FIG. 7, a block diagram is shown of a digital distance measuring system which is used to de-energize electromagnet 354 of tie plate holding device 250 when the tie plate is properly positioned over the tie, i.e., the tie plate 90 will be dropped at the longitudinal center of the tie regardless of the width of the particular tie under consideration. When the limit switch 370 is closed due to engagement with the trailing edge of a particular tie, pulses from the distance encoder are directed to divide by two circuit 378 and counted in tie width counter 380. When limit switch 370 is deactuated by the wheel 374 leaving the leading edge of the tie, the count in tie width represents ½ the width of the tie. This deactuation of limit switch 370 causes distance counter 382 to be reset to zero, the value in the tie width counter 380 to be put in memory 384 and made available to adder 386, the tie width counter to be reset to zero, and the pulses from the encoder 376 to be accumulated in distance counter 382. The value in memory 384 is summed with the value accumulating in distance counter 382 by adder 386. The sum out of adder 386 is compared in comparator 388 with a constant from store 390. The value of the constant represents the distance x from the limit switch 370 to the center of electromagnet 354 (see FIG. 4). When the value out of adder 384 equals the constant from store 390, the comparator 388 actuates relay 392 turning off the power to electromagnet 354 causing tie plate 90 to be dropped. The use of memory 384 allows the circuit to count on the next tie before it causes a tie plate to be dropped on a previous tie. This allows for different spacing of ties.

What I claim is:

1. A rail changing machine having means for removing rails from a track, means for lifting the tie plates from the old ties, means for preparing the old ties, means for relaying tie plates or the prepared ties and means for laying new rails in the relaid tie plates, wherein the means for lifting the tie plates comprises at each rail location a first magnetic wheel rotatably mounted on a lateral axis and also mounted for generally vertical movement, means for moving the first magnetic wheel vertically downward for engagement by its periphery with a tie plate on a tie and vertically upwards for raising the subsequently adhered tie plate off the tie, means for rotating stepwise the first magnetic wheel in the raised position to index a vacant space on the wheel periphery to a downward facing location of the wheel, means for removing from the magnetic wheel tie plates adhered thereto, and means for conveying the removed tie plates to a desired location.

2. A rail changing device according to claim 1, wherein the means for removing the tie plates from the first wheel is a stationary plate configured and disposed to engage the tie plates as the first wheel rotates thereby scraping the tie plates off the first magnetic wheel.

3. A rail changing machine according to claim 1 in which the wheel at each rail location is formed of non-magnetizable material except for its periphery and including a plurality of permanent magnets mounted in the wheel in engagement with the periphery.

4. A rail changing machine according to claim 1 wherein the first magnetic wheels at the two rail locations are mounted for conjoint lateral movement and including means for moving the first magnetic wheels laterally in response to signals from a centre line follower.

5. A rail changing machine according to claim 1, including at each rail location a second magnetic wheel aligned longitudinally with the first magnetic wheel and also rotatably mounted on a lateral axis, means for driving the second magnetic wheel at a predetermined speed in the opposite direction to rotation of the first wheel, a conveyor extending between the top of the first magnetic wheel adjacent the means for removing tie plates from the first magnetic wheel and the bottom of the second magnetic wheel, means for driving the conveyor at a speed corresponding to the peripheral speed of the second wheel whereby the plates removed from the first wheel upside down are conveyed to the second wheel to which they adhere, and means for removing tie plates from the top of the second wheel rightside up.

6. A rail changing machine according to claim 5 in which each wheel is formed of non-magnetizable material except for its periphery and including a plurality of permanent magnets mounted in each wheel in engagement with the periphery.

7. A rail changing machine according to claim 5 in which the first wheel and the conveyor are mounted on a sub-frame which is pivotable about the rotational axis of the second wheel and the means for moving the first wheel vertically comprises means for pivoting the sub-frame.

8. A rail changing machine, according to claim 7 in which the means for pivoting the sub-frame comprises a fluid cylinder connected between a vertically fixed member and a housing mounted on the sub-frame, the cylinder having a piston so configured relative to a hole in the housing that on retraction of the piston, the piston pulls up the sub-frame permits it to pivot down until the first wheel engages a tie plate, the housing containing a first limit switch which is arranged to be actuated by the piston when downward travel of the housing has ceased, the limit switch actuation causing retraction of the fluid cylinder and consequent raising of the first wheel and adhered tie plate.

9. A rail changing machine according to claim 8 in which a second limit switch is provided to sense a predetermined upward travel of the first wheel, the second limit switch being actuated by the pivoting sub-frame and being connected to circuitry disabling further retraction of the fluid cylinder.

10. A rail changing machine according to claim 9 in which the second limit switch is connected to circuitry which enables the indexing means when the second limit switch is actuated.

11. A rail changing device according to claim 7, wherein the means for removing the tie plates from the first and second wheels are respective stationary plates configured and disposed to engage the tie plates as the first and second wheels rotate thereby scraping the tie plates of the first and second magnetic wheels.

12. A rail changing machine according to claim 5 wherein the two magnetic wheels at one rail location are mounted for conjoint lateral movement and including means for moving the magnetic wheels laterally in response to signals from a centre line follower.

13. A rail changing machine according to claim 12 comprising matching means located at each of the second magnetic wheels for matching the laterally movable second wheel to a laterally fixed conveying means for conveying tie plates rearwardly along the rail changing machine, the matching means comprising a longitudinally arranged conveyor aligned longitudinally with the laterally fixed conveying means and a laterally arranged conveyor on each side of the longitudinally arranged conveyor, the laterally arranged conveyors being driven towards the longitudinally arranged conveyor.

14. A rail changing machine according to claim 13 comprising means for conveying the tie plates to the means for relaying tie plates which is located rearwardly of the means for lifting the tie plates at which relaying means the tie plates are positioned on the prepared ties.

15. A rail changing machine having means for removing rails from a track, means for lifting the tie plates from the old ties, means for preparing the old ties, means for relaying tie plates on the prepared ties and means for laying new rails in the relaid tie plates, wherein the means for relaying tie plates on the prepared ties comprises an electromagnetic holder adapted to receive the tie plates from a conveyor in the correct orientation, the electromagnetic holder being movable from a raised position for reception of a tie plate to a lowered position for dropping the tie plate on a tie, and means for measuring the location of successive ties, means for measuring the width of successive ties and means for de-energising the electromagnetic holder at a time depending upon the particular tie location measured and the particular tie width measured whereby said holder is properly positioned over the tie.

16. A rail changing machine according to claim 15 further comprising circuit means including a memory wherein at least two consecutive tie widths can be stored thereby permitting said holder to be properly positioned over the ties under conditions where there is different spacing between successive ties.

17. A rail changing machine having means for removing rails from a track, means for lifting the tie plates from the old ties, means for preparing the old ties, means for relaying the tie plates on the prepared ties, and means for laying new rails in the relaid tie plates, wherein the means for relaying the tie plates on the prepared ties comprises a holder adapted to receive the tie plates from a conveyor in the correction orientation, the holder being movable from a raised position for reception of a tie plate to a lowered position for dropping the tie plate on a tie, and means for measuring the location of successive ties, means for measuring the width of successive ties and means for causing said holder to drop said tie plate at a time depending upon the particular tie location measured and the particular tie width measured whereby said holder is properly positioned over the tie.

18. A rail changing machine according to claim 17 further comprising circuit means including a memory wherein at least two consecutive tie widths can be stored thereby permitting said holder to be properly positioned over the ties under conditions where there is different spacing between successive ties.

* * * * *